United States Patent [19]

Jensen et al.

[11] 4,447,189

[45] May 8, 1984

[54] CENTRIFUGAL PUMP FOR MOVING GASEOUS LIQUIDS

[75] Inventors: Niels D. Jensen; Kurt F. Nielsen, both of Bjerringbro, Denmark

[73] Assignee: Grundfos A/S, Bjerringbro, Denmark

[21] Appl. No.: 342,644

[22] Filed: Jan. 25, 1982

[30] Foreign Application Priority Data

Jan. 30, 1981 [DE] Fed. Rep. of Germany ... 810230[U]

[51] Int. Cl.[3] ..... F01D 25/30

[52] U.S. Cl. ..... 415/168; 415/121 A; 55/204

[58] Field of Search ..... 415/118, 168, 121 A, 415/201, 219 C, 121 G; 55/201, 204, 205, 459 A, 459 B, 459 C, 459 D, 459 R, 461; 210/512.1, 512.2

[56] References Cited

U.S. PATENT DOCUMENTS 3,715,863 2/1973 Zanomi ..... 55/204

4,358,299 11/1982 Jensen et al. ..... 55/204

FOREIGN PATENT DOCUMENTS 1937119 2/1971 Fed. Rep. of Germany ... 415/121 A

*Primary Examiner*—Stephen Marcus

*Assistant Examiner*—John Kwon

*Attorney, Agent, or Firm*—Michael N. Meller

[57] ABSTRACT

A centrifugal pump for moving gaseous liquids comprises a gas separator situated in the suction chamber of the pump. The outlet of the gas separator is aligned with the inlet of the impeller, the degased liquid passing through said outlet. The separated gas is drained off to the ambiency through a tapped hole in the pump casing, to which a ventilator is connected. The gas separator is mounted in its fitting position after it has been carried from the pressure chamber of the pump and through an opening in a partition between the suction chamber and the pressure chamber and further on into the suction chamber. The gas separator is retained in its fitting position by means of securing means in the positions in which the water and gas outlets of the gas separator are situated. As a result, the pump casing may be manufactured from a simple and relatively small moulding piece. The pump casing need not comprise several parts.

4 Claims, 2 Drawing Figures

CENTRIFUGAL PUMP FOR MOVING GASEOUS LIQUIDS

Figure 2:
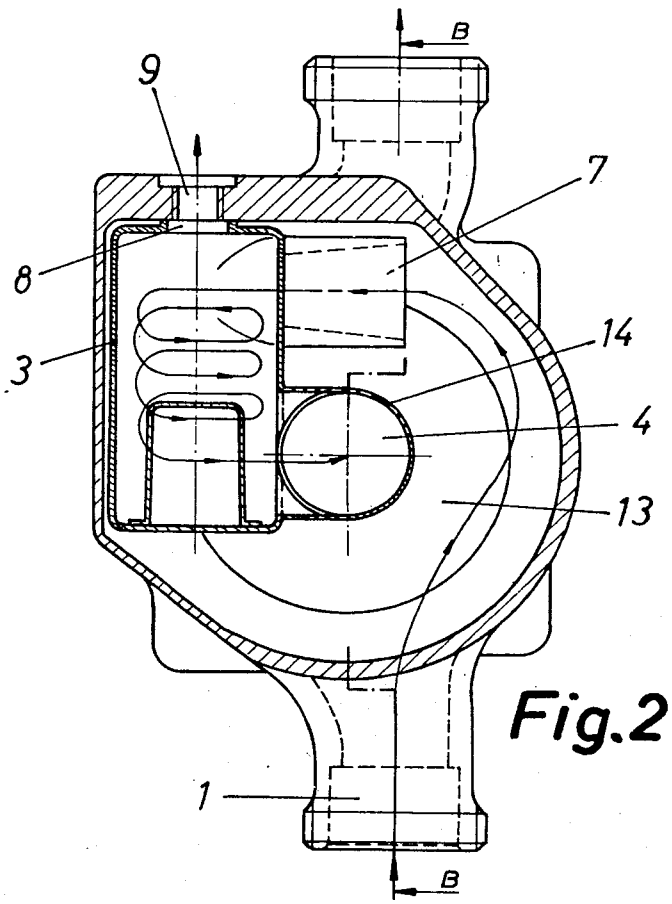

The invention relates to a centrifugal pump for moving gaseous liquids, whereby the separation of the gas from the liquid is carried out by means of a gas separator built into the suction chamber of the pump, the outlet of said separator being aligned with the inlet of the impeller and allowing the degassed liquid to pass on, whereas the separated gas is carried from the separator to the outside through a ventilator threaded into a tapped hole in the pump casing.

In pump systems, gas or air present in the pumped medium causes many disturbances. Thus the throttle curve may drop at increasing gas content in the pumped liquid. Furthermore, the operation of the pump causes certain difficulties in the portion in which the pump is only partly loaded because even minor disturbances on the suction side may cause interruptions in the flow of the pumped medium.

When the gas bubbles in the system combine into relatively large gas bubbles, and these large bubbles produced for instance by control operations in the pump reach the impeller of the pump together with the medium to be pumped, it is to be expected that the pump falls out. When said large bubbles reach the centrifugal section of the impeller, they are pressed towards the axis of rotation of the impeller and subsequently form a blocking on the suction side of the pump, whereby the pumping is obstructed.

In order to solve this problem, various gas separators have already been developed, said separators operating according to the principle of gravity or the centrifugal principle. Such gas separators are for instance known from the German patent applications or patent specifications Nos. 1,653,727; 1,973,119; 2,810,583; and 3,022,420. These known gas separators are formed by separate parts in the suction chamber of the pump and are primarily encumbered with the draw-back that they require considerable room for the pump casing. In addition, the pump casing usually requires the manufacture of several parts in order to permit mounting therein of the gas separator. In this manner the total mounting expenses are rather high. Furthermore, the securing of the gas separator requires expensive machining of the pump casing, as well as use of special securing means.

The object of the invention is to overcome these drawbacks. The centrifugal pump according to the invention is characterized in that the gas separator is mounted in the suction chamber, said gas separator during the mounting being carried from the pressure chamber of the pump and through an opening in the partition between the suction chamber and the pressure chamber and further on into said suction chamber, and that the fitted position of the gas separator is determined by securing means in the positions in which the water and gas outlets are situated.

The advantage of the above is primarily that the pump casing may be manufactured from a simple, uncomplicated, and small molding. Additionally, the mounting of the gas separator is carried out through the opening necessary for other reasons of said partition, so that in a way no construction alterations are required.

In some types of pumps, an annular disc is present in the opening of the partition, whereas a flange to be connected to the motor housing may be mounted on the side of the pump casing opposing the opening of the partition.

In this case, the opening of the partition and the flange opening need only be adapted to the dimensions of the gas separator in such a manner that said gas separator is insertable in the suction chamber through said two openings prior to the mounting of the annular disc.

Finally according to the invention, the gas separator may be clamped and fastened both in the radial and the axial direction by means of the annular disc, as well as the gas separator can be prevented from rotation by means of the adapter nipple on the ventilator, said adapter nipple substantially projecting radially into the gas outlet in the gas separator.

Figure 1:
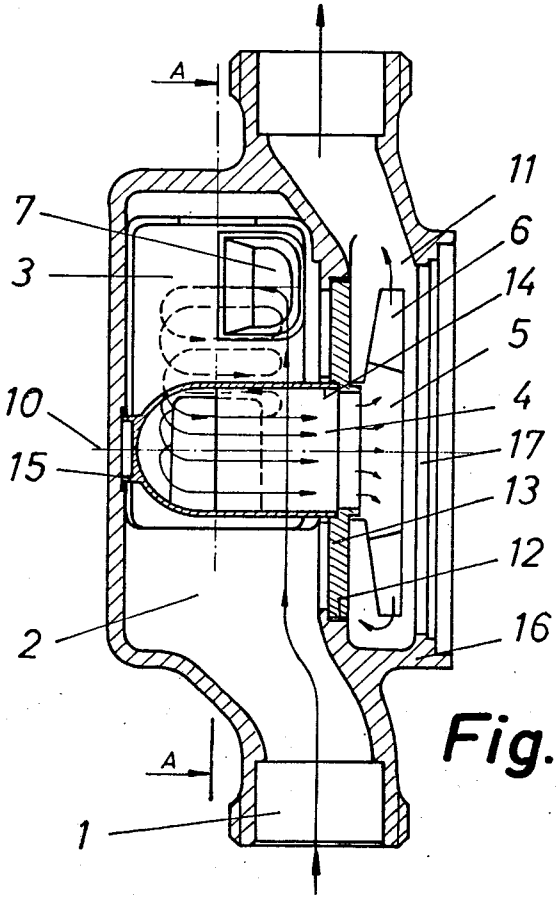

The invention will be described below with reference to the accompanying drawing, in which FIG. 1 is a longitudinal, sectional view taken along the line B—B of FIG. 2 of a centrifugal pump according to the invention, and FIG. 2 is a sectional view taken along the line A—A of FIG. 1 of the centrifugal pump of FIG. 1.

The illustrated pump is a circulating pump to be used for heating and tapwater systems. In the pump casing of the pump, a suction chamber 2 is provided, within which gaseous liquid may flow through a suction pipe stub 1. A gas separator 3 is mounted in the suction chamber 2 and operates according to the centrifugal principle. The outlet 4 of this separator is secured by axially extending abutment means 15 in the left hand wall (as seen in FIG. 1) of casing and is directed towards the inlet 5 of the impeller 6 of the pump. The gas separator comprises a water inlet 7 situated in the upper portion of the suction chamber 2.

The substantially cylindrical gas separator 3 comprises at its upper end an outlet 8 for draining off of the separated gas. This opening flushes with a taphole 9, in which an adapter nipple is threaded into a ventilator known per se and not illustrated. The threading is performed so far that the adapter nipple projects into the outlet opening 8 so that the gas separator 3 is ensured against rotation about its longitudinal axis 10. A circular opening 12 is provided in a partition between the suction chamber 2 and the pressure chamber 11. Into this circular opening, an annular disc 13 is pressed. The gas separator comprises a short pipe stub 14 forming the water outlet thereof. The free end of this stub is on the outside surrounded by the rim of the central hole in the annular disc 13. In this manner it is ensured that the right end of the gas separator illustrated in FIG. 1 cannot be displaced radially relative to the longitudinal axis 10. An additional fastening of the gas separator is provided by means of an abutment part 15 situated on the other end of the gas separator, cf. FIG. 1. This abutment part 15 projects into a recess in the pump casing and opposes the opening 12 of the partition and the annular disc 13. The gas separator 3 is besides also clamped and fastened in the axial direction by means of the annular disc 13.

The pump casing comprises a flange 16 with an opening 17 opposing a motor not shown. One end of the motor driving the pump may be coupled to this flange in a usual manner.

The two openings 12 and 17 are dimensioned in such a manner that prior to the mounting of the annular disc 13 and the impeller 6, the gas separator 3 is capable of inserting for assembly from the outside and through the opening 17 carried through the pressure chamber 11 and subsequently through the opening 12 into the suction chamber 2. The gas separator 3 is subsequently directed in the correct fitting position by the annular disc 13 being pressed into its position. Subsequently, the ventilating means with associated adapter nipple is threaded into the hole 9 until said adapter nipple catches the gas outlet 8 of the gas separator 3. Finally the impeller 6 is mounted.

The gas separator according to the invention may comprise one or several parts of plastics and be made by injection moulding. When the gas separator comprises several parts, these parts may be kept assembled by means of the annular disc 13 as well as said securing means. The walls of the gas separator, which from a geometric point of view are rather complicated, are not influenced by the system pressure of the pump system, but only by the minor loss of pressure produced by the gas separator. The resulting outer pressure is, however, sufficient for keeping together the possibly many parts of the gas separator without necessitating threaded joints or the like securing means.

I claim:

1. A centrifugal pump comprising:

(a) a one-piece pump casing configured so as to define a suction chamber and a pressure chamber, said suction and pressure chambers communicating via an interchamber opening and said pump casing having a gas exhaust taphole communicating with said suction chamber;

(b) a disc having a configuration which conforms to the configuration of said interchamber opening and having a central opening;

(c) a gas separator mounted in said suction chamber, said gas separator comprising a gas-water inlet, a water outlet and a gas outlet said gas separator being fastened relative to the longitudinal axis of the pump both in the radial and the axial direction by means of said disc and an axial abutment means so that said gas separator is prevented from rotation (d) an impeller formed separately from said disc and including an inlet, wherein said water outlet is secured to the casing wall by said axial abutment and is connected to said central opening, said central opening being connected to said impeller inlet with said gas separator being rigidly fixed in relation to said suction chamber by securing means at said water and gas outlets.

2. A centrifugal pump as claimed in claim 1, wherein said disk in annular, said pump casing comprises a flange, said flange confronting said interchamber opening and defining a motor housing opening, and said gas separator is configured and dimensioned such that said gas separator can pass through said interchamber opening and said motor housing when being assembled.

3. A centrifugal pump as claimed in claim 2, further comprising a ventilator inserted in said taphole, wherein said securing means-exhaust taphole comprise an adaptor nipple attached to said ventilator and a recess in said annular disk, said recess encircling said central opening, such that said gas separator is rigidly fixed by means of said water outlet projecting into said recess and by means of said adaptor nipple projecting into said gas outlet.

4. A centrifugal pump as claimed in claim 3, wherein said pump casing has a recess in said suction chamber confronting said interchamber opening and said gas separator comprises a substantially axially extending abutment part projecting into said recess for securing the same.

* * * * *